US011793244B2

(12) United States Patent
Ryan et al.

(10) Patent No.: US 11,793,244 B2
(45) Date of Patent: Oct. 24, 2023

(54) ATHLETIC PROTECTIVE BREAST CUP

(71) Applicant: Unstoppable Protective Gear, LLC, Manhattan Beach, CA (US)

(72) Inventors: Taylor Rebecca Ryan, Manhattan Beach, CA (US); Rodolfo Gastelum, Manhattan Beach, CA (US)

(73) Assignee: Unstoppable Protective Gear, LLC, Manhattan Beach, CA (US)

( * ) Notice: Subject to any disclaimer, the term of this patent is extended or adjusted under 35 U.S.C. 154(b) by 68 days.

(21) Appl. No.: 17/444,098

(22) Filed: Jul. 30, 2021

(65) Prior Publication Data

US 2022/0087331 A1 Mar. 24, 2022

Related U.S. Application Data

(60) Provisional application No. 63/036,079, filed on Jun. 8, 2020.

(51) Int. Cl.
*A41C 3/00* (2006.01)
*A41D 13/05* (2006.01)

(52) U.S. Cl.
CPC ..... *A41C 3/0071* (2013.01); *A41D 13/0518* (2013.01)

(58) Field of Classification Search
CPC .. A41C 3/0071; A41C 3/142; A41D 13/00518
USPC ..... 2/463
See application file for complete search history.

(56) References Cited

U.S. PATENT DOCUMENTS 849,471 A * 4/1907 Gamble ..... A63B 71/1216 2/466
2,054,491 A * 9/1936 Tynan ..... A61F 13/141 604/374
2,061,268 A * 11/1936 Becker ..... A41C 3/10 450/39
2,490,508 A * 12/1949 Delgatto ..... A42B 1/002 223/84
2,495,307 A * 1/1950 Abramson ..... A61F 13/141 2/463
2,579,365 A * 12/1951 Conde ..... A41C 3/10 D2/706
2,659,085 A * 11/1953 Ericson ..... A41C 3/0014 450/39
2,756,911 A * 7/1956 Kantor ..... A47F 8/02 223/68
2,815,157 A * 12/1957 Badgley ..... D06F 59/02 223/89
2,864,373 A * 12/1958 Buckley ..... A41C 3/105 450/38
2,951,621 A * 9/1960 Cheney ..... D06F 59/02 223/66
3,085,723 A * 4/1963 Vanderburg ..... D06F 59/02 223/66

(Continued)

*Primary Examiner* — Jocelyn Bravo
(74) *Attorney, Agent, or Firm* — Squire Patent Consulting & IP Law LLC; Brendan E. Squire

(57) ABSTRACT

A protective cup to be worn in women athlete's sports bras to protect against injury and pain from a contact in an aggressive sport. is disclosed. The Unstoppable Protective Cups can be slipped into the athlete's favorite sports bra, go virtually undetected, easy to run in with a flexible cut-out to absorb a blow. They are also lined with softer material to protect the breast from injury further and be worn with comfort.

20 Claims, 4 Drawing Sheets

(56) References Cited

U.S. PATENT DOCUMENTS 3,176,686 A * 4/1965 Barnes ..... A63B 71/12 602/73
3,478,739 A * 11/1969 Librande ..... A41C 3/00 2/463
3,513,852 A * 5/1970 Seidl ..... A41C 3/04 450/39
3,532,096 A * 10/1970 Seidl ..... A61F 13/141 450/86
4,043,329 A * 8/1977 DiMatteo ..... A63B 71/1216 128/846
4,100,621 A * 7/1978 Ettipio ..... A61F 2/52 450/32
4,217,905 A 8/1980 Atwater et al.
4,222,388 A * 9/1980 Brown ..... A41C 3/144 450/55
4,270,538 A * 6/1981 Murphy ..... A61M 1/062 450/37
4,272,847 A * 6/1981 Buhler ..... A63B 71/12 2/463
4,441,211 A * 4/1984 Donzis ..... A63B 71/12 2/463
4,508,110 A * 4/1985 Modglin ..... A61F 5/022 2/908
4,566,458 A * 1/1986 Weinberg ..... A41C 3/14 128/890
5,020,157 A 6/1991 Dyer
5,022,887 A * 6/1991 Lawson ..... A41C 3/0057 450/32
5,032,103 A * 7/1991 Larsson ..... A61J 13/00 450/38
5,062,433 A * 11/1991 Kummer ..... A41D 13/0506 428/116
5,244,432 A 9/1993 Moy Au et al.
5,281,186 A * 1/1994 Buckley ..... A41C 3/142 450/38
5,429,593 A * 7/1995 Matory ..... A61F 13/145 602/61
5,556,013 A * 9/1996 Mayer ..... D06F 95/008 223/66
5,557,804 A * 9/1996 Ovortrup ..... A41D 13/0506 2/467
5,683,286 A * 11/1997 Kielland ..... A61F 13/141 450/37
5,769,688 A * 6/1998 Holliday ..... A41C 3/0057 450/55
5,806,103 A * 9/1998 McCracken ..... A41D 13/0017 2/463
5,842,232 A * 12/1998 Parrish ..... A41D 13/0575 450/97
5,971,236 A * 10/1999 DesForges ..... D06F 95/008 223/66
6,083,080 A * 7/2000 Lawson ..... A41C 3/10 450/39
6,110,005 A * 8/2000 Stephenson ..... A41C 3/10 450/39
6,161,226 A * 12/2000 Serewicz ..... A41D 13/0518 2/45
6,183,340 B1 * 2/2001 Wen ..... A41C 3/065 450/1
6,234,368 B1 * 5/2001 DesForges ..... D06F 95/006 223/66
6,299,505 B1 * 10/2001 Huang ..... A41C 3/144 450/57
6,338,665 B1 * 1/2002 Dawson ..... A41C 3/065 450/39
6,375,537 B1 * 4/2002 Jankowski ..... A63B 71/12 2/463
6,419,548 B1 * 7/2002 Wittes ..... A41C 3/065 450/57
6,540,585 B1 * 4/2003 Lee ..... A41C 3/10 450/55
6,688,942 B2 2/2004 Holliday
6,742,683 B1 * 6/2004 Phan ..... D06F 95/008 223/84
6,811,463 B2 11/2004 Martz
6,878,034 B1 * 4/2005 Cisneros ..... A41C 3/12 604/385.07
6,881,123 B1 * 4/2005 Klakauskas ..... A41C 3/10 450/39
6,962,519 B1 * 11/2005 Clark ..... A61J 13/00 450/39
7,252,573 B2 * 8/2007 Mann ..... D06F 95/008 223/69
7,442,110 B2 * 10/2008 Gaudet ..... A41C 3/144 450/39
7,739,753 B2 * 6/2010 Jankowski ..... A41C 3/0057 2/92
7,900,285 B2 * 3/2011 Steszyn ..... A63B 71/1216 2/466
8,353,062 B2 * 1/2013 Landi ..... A41D 13/05 2/24
9,770,056 B2 * 9/2017 Sung ..... A41C 3/0085
10,028,540 B2 * 7/2018 Shearer ..... A41C 3/0057
11,071,335 B2 * 7/2021 Kulkarni ..... A41D 13/0518
11,311,062 B2 * 4/2022 Roque ..... A41D 13/0562
2002/0132558 A1 * 9/2002 Holliday ..... A41C 3/142 450/1
2003/0163076 A1 * 8/2003 Lukens ..... G09F 21/02 2/466
2003/0220048 A1 * 11/2003 Toro ..... A61F 13/141 450/57
2004/0142634 A1 * 7/2004 Luk ..... A41C 5/005 450/57
2006/0157065 A1 * 7/2006 Rohrig ..... A61J 13/00 128/890
2007/0123144 A1 * 5/2007 Mann ..... D06F 95/008 450/1
2007/0155283 A1 * 7/2007 McQueer ..... A41C 3/0057 450/39
2009/0249555 A1 * 10/2009 Dewhurst ..... D06M 13/256 8/115.56
2010/0089779 A1 * 4/2010 Bowers ..... G06F 1/1628 206/521
2015/0118937 A1 * 4/2015 Wan ..... A41C 3/0085 450/92
2016/0150834 A1 * 6/2016 Boele ..... A41C 3/04 450/36
2017/0036416 A1 * 2/2017 Wyner ..... B32B 5/24
2017/0055602 A1 * 3/2017 Abraham ..... A41C 3/0057
2017/0119063 A1 * 5/2017 Diaz ..... D04B 35/10
2017/0290376 A1 * 10/2017 Maheshwari ..... D04B 21/207
2020/0268062 A1 * 8/2020 Palese ..... A41C 3/12
2021/0007418 A1 * 1/2021 Kim ..... A41C 3/144
2021/0169153 A1 * 6/2021 Inselberg ..... A41C 3/0014
2021/0361473 A1 * 11/2021 Crowe ..... H02J 7/0045

* cited by examiner

ATHLETIC PROTECTIVE BREAST CUP

CROSS-REFERENCE TO RELATED APPLICATION

This application claims the benefit of priority of U.S. provisional application No. 63/036,079 filed Jun. 8, 2020, the contents of which are herein incorporated by reference.

BACKGROUND OF THE INVENTION

The present invention relates to protective athletic equipment, and more particularly to athletic protective gear for the breasts.

Millions of women and girls are going out to play aggressive sports unprotected. Men and boys have had protective gear for their sensitive areas for decades, yet girls have not. A study published in the European Journal of Breast Health, entitled "Breast Injuries in Female Collegiate Basketball, Soccer, Softball and Volleyball Athletes: Prevalence, Type and Impact on Sports Participation"[1], is highly concerning.

[1] "Breast Injuries in Female Collegiate Basketball, Soccer, Softball and Volleyball Athletes: Prevalence, Type and Impact on Sports Participation, Laura J. Smith, Tamara D. Eichelberger, and Edward J. Kane, *Eur J Breast Health.* 2018 January; 14(1): 46-50 Available at https://www.ncbi.nlm.nih.gov/pmc/articles/PMC5758063/

The study indicates that almost half of the 194 participants (47.9%) reported a breast injury during their collegiate career, less than 10% reported their injury to health personnel with 2.1% receiving treatment. Breast injuries reported by sport include softball (59.5%), basketball (48.8%), soccer (46.7%), and volleyball (34.6%).

The study's authors conclude that the long-term effects and sequelae of breast injuries reported by female collegiate athletes during sport play are unknown. Nearly 50% of participants had a breast injury during sports activities. Although 18.2% indicated that breast injury affected sports participation, only 9.6% of the injuries were reported to medical personnel with 2.1% receiving treatment.

There are very few choices in protective gear for Women athletes. Most look like a chest plate or are not flexible. If the protective gear does not flex, it still digs into the breast tissue when hit. Also, very few athletes in competitive sports find it comfortable to run down a field on a chest plate.

The high incidence of breast injuries indicates, there is a need for improved athletic protective breast cup for women.

SUMMARY OF THE INVENTION

In one aspect of the present invention, an athletic protective breast cup is disclosed. The athletic protective breast cup includes an outer shell having a curvature dimensioned to contain a breast of a wearer. A plurality of flexural slots are disposed about the outer shell. The plurality of flexural slots are configured to allow for a flexure of a defined flexural region of the outer shell responsive to an impact force exerted on the outer shell. A central void portion is defined in the outer shell positioned to overly a nipple of the wearer, when worn.

In some embodiments an interior flexural slot of the plurality of flexural slots define a plurality of major flexural regions in the outer shell. The interior flexural slot intersects with the central void portion.

In some embodiments, the interior flexural slot extends from a top end of the outer shell, through the central void portion, and downwardly to a bottom end of the outer shell. Terminal ends of the interior flexural slot terminate spaced apart from a peripheral side edge of the outer shell. An upper end of the interior flexural slot is oriented inwardly to provide for improved flexing of a top flexural region of the outer shell. A lower end of the interior flexural slot is oriented outwardly to provide for a lower flexural region that is dispersed across a lower aspect of the outer shell.

In some embodiments, a lateral flexural slot of the plurality of flexural slots is generally vertically aligned at a lateral aspect of the outer shell and inwardly spaced from a peripheral side edge of the outer shell. An upper end of the lateral flexural slot may be oriented inwardly, and a lower end of the lateral flexural slot may be oriented outwardly.

In some embodiments, a cushioned liner is disposed over an interior surface of the outer shell. An outer surface of the cushioned liner is configured to protrude through the plurality of flexural slots.

In other embodiments, a plurality of nubs protrude from an outer surface of the outer shell.

In other aspects of the invention, an athletic protective breast cup may include an outer shell having a curvature dimensioned to contain a breast of a wearer. The outer shell has a plurality of flexural slots disposed about the outer shell. The plurality of flexural slots are configured to allow for a flexure of a defined flexural region of the outer shell responsive to an impact force exerted on the outer shell. A central void portion is defined in the outer shell positioned to overly a nipple of the wearer, when worn. A cushioned liner is disposed over an interior surface of the outer shell.

In some embodiments, an outer surface of the cushioned liner is configured to protrude through the plurality of flexural slots.

In other embodiments, a plurality of nubs protrude from an outer surface of the outer shell.

These and other features, aspects and advantages of the present invention will become better understood with reference to the following drawings, description and claims.

DETAILED DESCRIPTION

Figure 1:
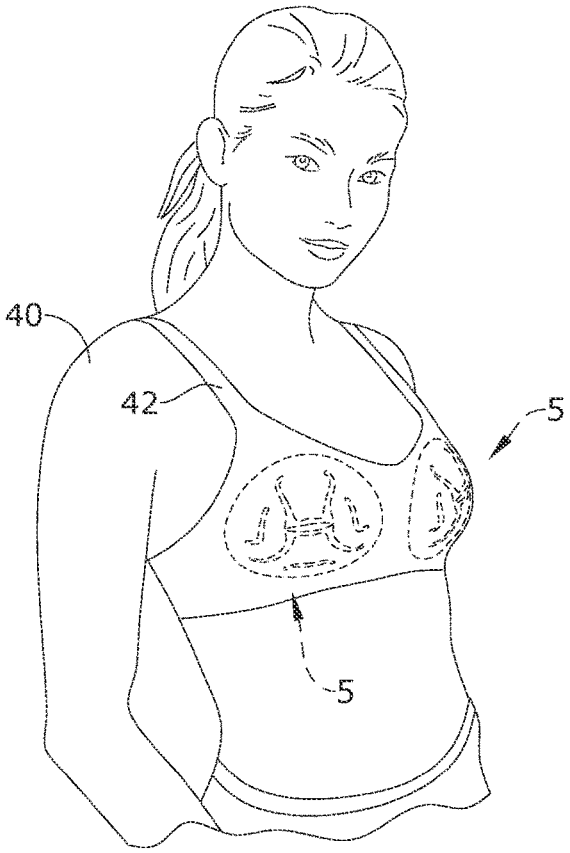
FIG. 1 is a perspective view of the athletic protective breast cup, shown in use.
Figure 2:
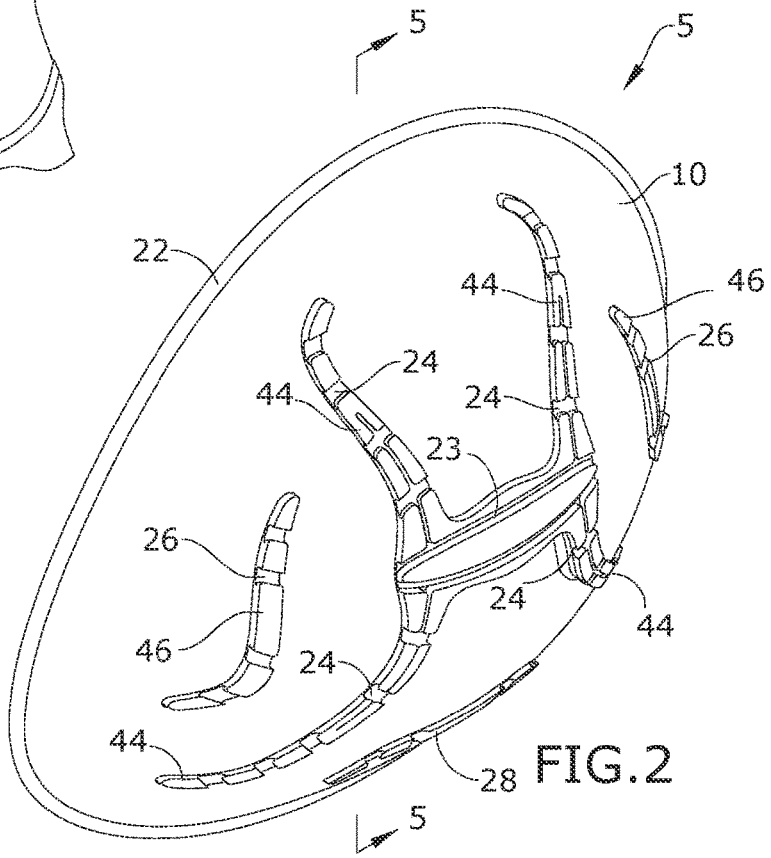
FIG. 2 is a perspective view of the athletic protective breast cup.
Figure 3:
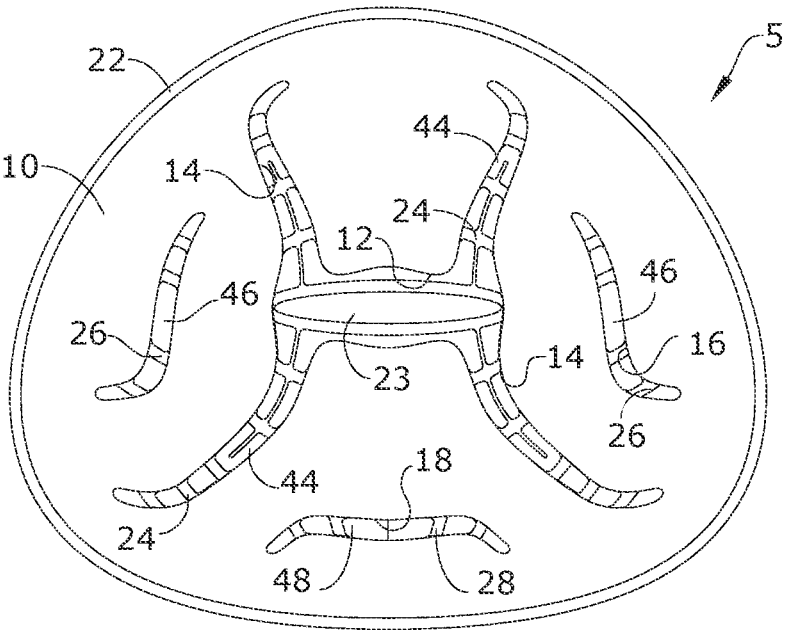
FIG. 3 is a front view of the athletic protective breast cup.
Figure 4:
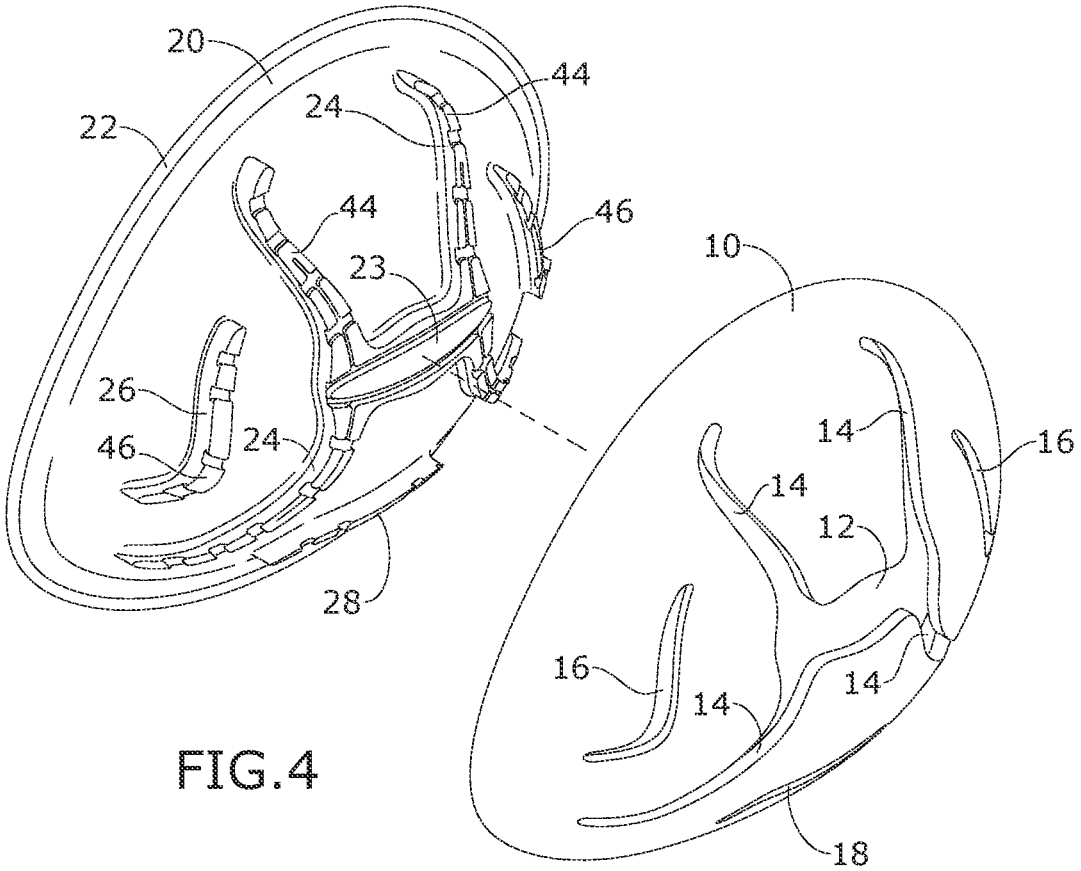
FIG. 4 is an exploded view of the athletic protective breast cup.
Figure 5:
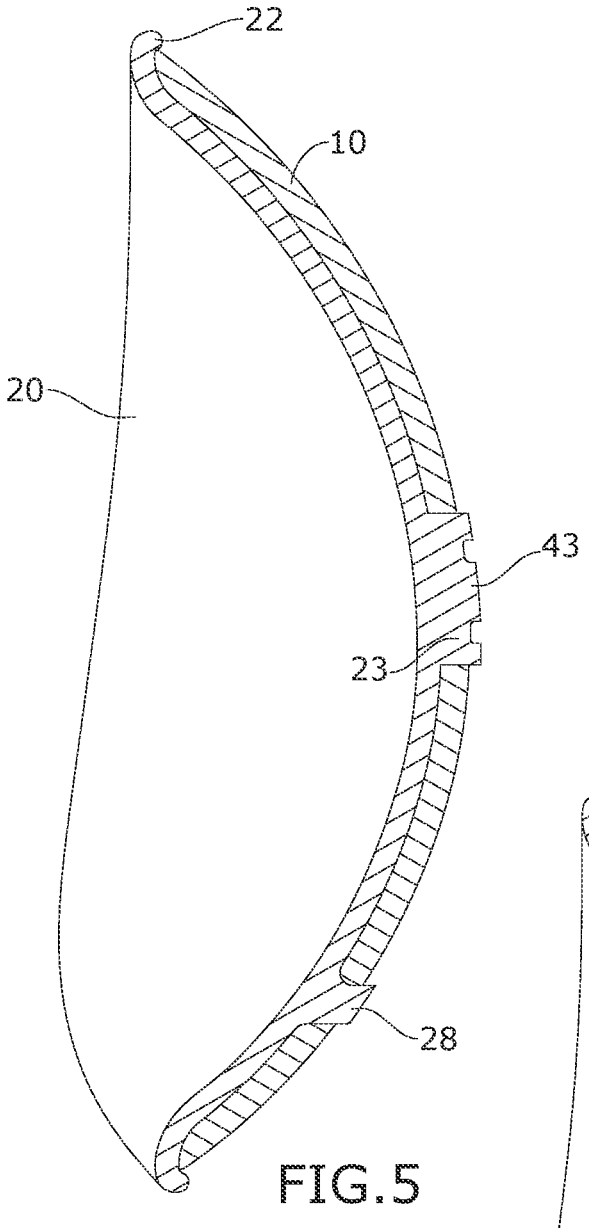
FIG. 5 is a section view of the athletic protective breast cup, taken along line 5-5 in FIG. 2.
Figure 6:
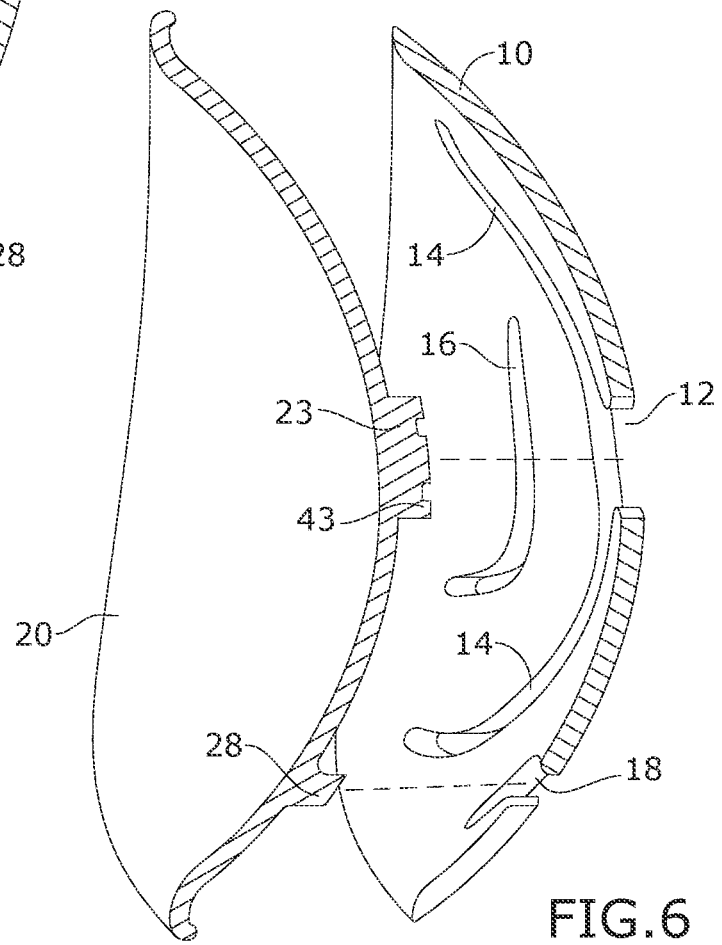
FIG. 6 is an exploded section view of the athletic protective breast cup.

The following detailed description is of the best currently contemplated modes of carrying out exemplary embodiments of the invention. The description is not to be taken in a limiting sense but is made merely for the purpose of illustrating the general principles of the invention.

Broadly, embodiments of the present invention provide an athletic protective breast cup that can easily be slipped into any sports bra to protect the athlete's breast. The cups are easy to carry in a sports bag, and they have a hard outer shell with an impact cut out's to absorb a hit and a soft inner layer for comfort.

As seen in reference to the drawings of FIGS. 1-8, an athletic protective breast cup 5 includes an outer shell 10 that has a curvature to contain a breast of the wearer. The outer shell 10 is formed of a substantially rigid material, such as a thermoplastic, or a composite. A plurality of slots 14, 16, 18 are disposed about the outer shell 10. The plurality of slots 14, 16, 18 are configured to allow for a flexure of a defined flexural region of the outer shell 10, responsive to an impact force exerted on the outer shell 10. A central void portion 12 is defined in the outer shell 10 in a position overlying a nipple of the wearer 40. The central void portion 12 intersects with an interior flexural slot 14 of the plurality of slots to define major flexural regions in the outer shell.

A cushioned liner 20 is disposed over an interior surface of the outer shell 10. The cushioned liner 20 may be made of a resilient foam material, a neoprene, an elastomeric material, or a silicone. The cushioned 20 liner is provided to cushion the outer shell 10 when positioned against the wearer's breast and to absorb some of the impact forces exerted on the outer shell 10. An inner, breast facing surface of the cushioned liner 10 is preferably smooth for wearer comfort against the breast. An outer surface 25 of the cushioned liner 20 is configured to protrude through the central void portion 12 and the plurality of slots 14, 16, 18.

A plurality of nubs 43, 44, 46, 48 may be formed at the ends of the protruding liner to extend from an outer surface of the outer shell 10 to facilitate retention and placement of the athletic protective breast cup 5 on the wearer's breast when inserted beneath a support garment 42 worn by the wearer 40. As will be appreciated, the plurality of nubs 43, 44, 46, 48 may be formed on and protrude from the outer shell 10. The cushioned liner 20 may extend to cover a peripheral edge surface of the outer shell 10.

The plurality of slots 14, 16, 18 include the interior flexural slot 14, a lateral flexural slot 16 and a lower transverse flexural slot 18. The interior flexural slot 14 extends from a top end 30 of the outer shell 10, through the central void portion 12, and downwardly to a bottom end 32 of the outer shell 10. The interior flexural slots 14 are disposed to define major flexural regions 34, 35, 36, 38 of the outer shell 10. Ends of the interior flexural slot 14 terminate spaced apart from the peripheral side edge 11 of the outer shell 10. In a preferred embodiment, the upper ends of the interior flexural slot 14 are oriented inwardly to provide for improved flexing of a top flexural region 34 of the shell 10. The lower ends of the interior flexural slot 14 are oriented outwardly to provide for a lower flexural region 36 that is dispersed across a lower aspect of the outer shell 10.

The lateral flexural slot 16 is generally vertically aligned at the lateral aspects of the outer shell 10 inwardly spaced from the peripheral side edge 11 of the outer shell 10. In a preferred embodiment, an upper end of the lateral flexural slot 16 is oriented inwardly, while a lower end of the lateral flexural slot 16 is oriented outwardly. The lateral flexural slot 16 provides a supplemental flexure region 35 to lateral flexural regions 38 of the outer shell 10.

The protrusions 23, 24, 26, 28 of the cushioned liner 20 through the corresponding plurality of slots 14, 16, 18 prevents a pinch hazard of the flexural regions with the wearer's breast. The protrusions 23, 24, 26, 28 of the cushioned liner 20 through the plurality of slots 14, 16, 18 also restrict and limit the degree of flexure of each of the flexural regions.

Figure 7:
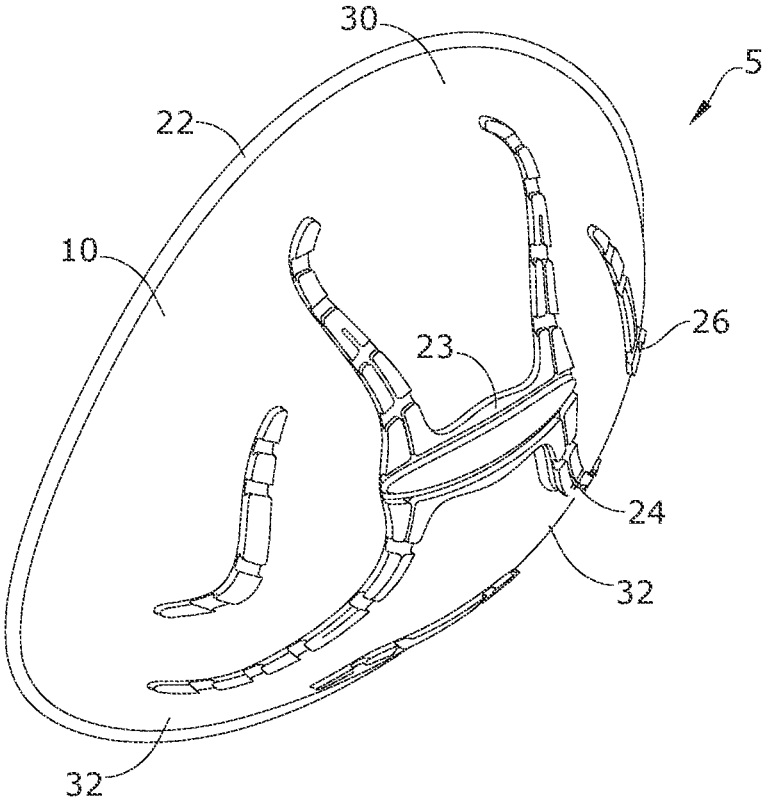
FIG. 7 is a perspective view of an alternate embodiment of the athletic protective breast cup.
Figure 8:
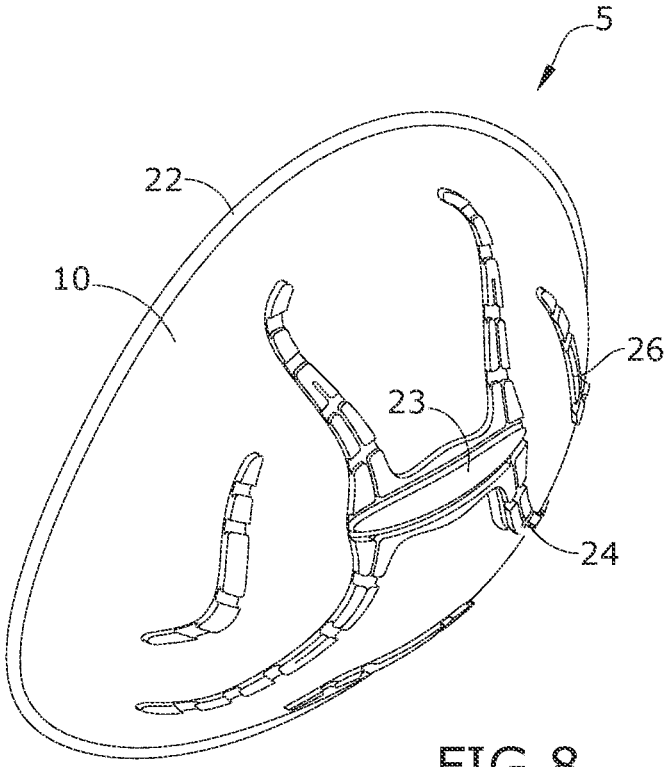
FIG. 8 is a perspective view of an alternate embodiment of the athletic protective breast cup.

As will be appreciated, the athletic protective breast cup 5 may be formed and sized to a range of breast sizes and shapes according to conventional sizing for breast support garments 42, such as shown in the alternative embodiments of FIGS. 7 and 8.

In use, the athlete simply inserts the athletic protective breast cup 5 beneath the breast support garment 42 and positions the central void 12 over the nipple area. The athlete may then adjust the position of the breast support garment 42 over the athletic protective breast cup 5 so that the nubs engage with the breast support garment 42.

It should be understood, of course, that the foregoing relates to exemplary embodiments of the invention and that modifications may be made without departing from the spirit and scope of the invention as set forth in the following claims.

What is claimed is:

1. An athletic protective breast cup, comprising:

a substantially rigid outer shell having a curvature dimensioned and configured to contain a breast of a wearer;

a plurality of flexural slots disposed about the outer shell, wherein the plurality of flexural slots extend through the outer shell and include an interior flexural slot that defines a plurality of major flexural regions of the outer shell, the plurality of major flexural regions oriented to flex the outer shell radially inwardly about an apex of the outer shell responsive to an impact force exerted on the outer shell;

a central void portion defined through the apex of the outer shell positioned to overlie a nipple of the wearer, when worn; and the interior flexural slot intersects with the central void portion.

2. The athletic protective breast cup of claim 1, wherein the interior flexural slot extends from a top end region of the outer shell, through the central void portion, and downwardly to a bottom end region of the outer shell, wherein terminal ends of the interior flexural slot terminate spaced apart from a peripheral side edge of the outer shell.

3. The athletic protective breast cup of claim 2, wherein an upper end of the interior flexural slot is oriented inwardly along a vertical centerline of the athletic protective breast cup to define a top flexural region of the outer shell.

4. The athletic protective breast cup of claim 2, wherein a lower end of the interior flexural slot is oriented outwardly from a vertical centerline of the athletic protective breast cup to define a lower flexural region that is disposed across a lower aspect of the outer shell.

5. The athletic protective breast cup of claim 1, wherein the plurality of flexural slots includes a lateral flexural slot that is generally vertically aligned at a lateral aspect of the outer shell, inwardly spaced from a peripheral side edge of the outer shell.

6. The athletic protective breast cup of claim 5, wherein an upper end of the lateral flexural slot is oriented inwardly relative to a vertical centerline of the athletic protective breast cup, and a lower end of the lateral flexural slot is oriented outwardly relative to the vertical centerline of the athletic protective breast cup.

7. The athletic protective breast cup of claim 1, further comprising:

a cushioned liner disposed over an interior surface of the outer shell.

8. The athletic protective breast cup of claim 7, wherein an outer surface of the cushioned liner is configured to protrude through the plurality of flexural slots.

9. The athletic protective breast cup of claim 8, wherein the cushioned liner includes a plurality of nubs that protrude beyond an outer surface of the outer shell.

10. An athletic protective breast cup, comprising:

an outer shell having a curvature dimensioned and configured to contain a breast of a wearer, the outer shell having a plurality of flexural slots disposed about the outer shell, wherein the plurality of flexural slots extend through the outer shell defining a plurality of flexural regions in the outer shell radially disposed about an apex of the outer shell, the plurality of flexural regions defining a plate structure that is responsive to an impact force exerted on the outer shell;

a central void portion defined through the apex of the outer shell, positioned to overlie a nipple of the wearer, when worn;

a cushioned liner disposed over an interior surface of the outer shell; and at least one protrusion of an outer surface of the cushioned liner extends through at least one of the plurality of flexural slots.

11. The athletic protective breast cup of claim 10, wherein the at least one protrusion includes a plurality of protrusions on the outer surface of the cushioned liner, wherein each protrusion is configured to protrude through a respective flexural slot of the plurality of flexural slots.

12. The athletic protective breast cup of claim 10, wherein the cushioned liner includes a plurality of nubs on the at least one protrusion that protrude beyond an outer surface of the outer shell.

13. An athletic protective breast cup, comprising:

a substantially rigid outer shell having a curvature dimensioned and configured to contain a breast of a wearer;

a plurality of flexural slots disposed about the outer shell, wherein the plurality of flexural slots extend through the outer shell to define a plurality of flexural regions in the outer shell, wherein each of the plurality of flexural regions are oriented to flex inwardly from an apex of the outer shell in response to an impact force exerted on the outer shell;

a central void portion defined through the outer shell proximal to the apex and positioned to overlie a nipple of the wearer, when worn;

a cushioned liner disposed over an interior surface of the outer shell, the cushioned liner having a plurality of protrusions extending through the central void portion and the plurality of flexural slots.

14. The athletic protective breast cup of claim 13, wherein the plurality of flexural slots includes an interior flexural slot, the plurality of flexural regions including a top flexural region disposed above the central void portion, a lower flexural region that is disposed across a lower aspect of the outer shell, and a lateral flexural region disposed on opposed lateral sides of the outer shell, the plurality of flexural slots oriented to flex inwardly about the central void portion.

15. The athletic protective breast cup of claim 14, further comprising:

an outer flexural slot defined in the lateral flexural region defining a supplemental flexure region.

16. The athletic protective breast cup of claim 13, further comprising:

a plurality of nubs disposed at the ends of the plurality of protrusions.

17. The athletic protective breast cup of claim 13, wherein a peripheral edge of the cushioned liner overlies a peripheral edge of the outer shell.

18. The athletic protective breast cup of claim 17, wherein the peripheral edge of the cushioned liner protrudes above an outer surface of the outer shell.

19. An athletic protective breast cup, comprising:

a substantially rigid outer shell having a curvature dimensioned and configured to contain a breast of a wearer;

a plurality of flexural slots disposed about the outer shell, wherein the plurality of flexural slots extend through the outer shell and define a plurality of flexural regions of the outer shell, the plurality of flexural regions oriented to flex the outer shell radially inwardly about an apex of the outer shell responsive to an impact force exerted on the outer shell;

a central void portion defined through the apex of the outer shell positioned to overlie a nipple of the wearer, when worn;

a cushioned liner disposed over an interior surface of the outer shell; and one or more protrusions on an outer surface of the cushioned liner that extend through at least one of the plurality of flexural slots.

20. The athletic protective breast cup of claim 19, further comprising:

a plurality of nubs disposed at an outer end of the one or more protrusions, the plurality of nubs extending beyond an outer surface of the outer shell.

* * * * *